US006004735A

United States Patent [19]

Schell et al.

[11] Patent Number: 6,004,735

[45] **Date of Patent: *Dec. 21, 1999**

[54] STAIN RESISTANT PROTECTIVE OVERCOAT FOR IMAGING ELEMENTS

[75] Inventors: Brian A. Schell, Honeoye Falls; Charles C. Anderson, Penfield, both of N.Y.

[73] Assignee: Eastman Kodak Company, Rochester, N.Y.

[ * ] Notice: This patent is subject to a terminal disclaimer.

[21] Appl. No.:

09/019,093

[22] Filed:

Feb. 5, 1998

[51] Int. Cl.[6] ..... G03C 1/81; G03C 1/89; G03C 1/76

[52] U.S. Cl. ..... 430/527; 430/66; 430/531; 430/536; 430/934; 430/961

[58] Field of Search ..... 430/536, 961, 430/527, 531, 934, 66

[56] References Cited

U.S. PATENT DOCUMENTS

| | | | |
|---|---|---|---|
| Re. 34,348 | 8/1993 | Heilmann et al. . | |
| 3,574,791 | 4/1971 | Sherman et al. . | |
| 3,728,151 | 4/1973 | Sherman et al. . | |
| 4,579,924 | 4/1986 | Schwartz et al. . | |
| 5,350,795 | 9/1994 | Smith et al. . | |
| 5,607,663 | 3/1997 | Rozzi et al. . | |
| 5,662,887 | 9/1997 | Rozzi et al. . | |
| 5,674,671 | 10/1997 | Brandon et al. | 430/961 |
| 5,679,505 | 10/1997 | Tingler et al. | 430/523 |
| 5,786,134 | 7/1998 | Nair et al. | 430/536 |
| 5,824,461 | 10/1998 | Schell et al. | 430/536 |

*Primary Examiner*—Richard L. Schilling
*Attorney, Agent, or Firm*—Carl F. Ruoff

[57] ABSTRACT

The present invention is an imaging element including a support, having at least one image forming layer, and having at least one stain resistant overcoat layer. The stain resistant overcoat layer contains a fluoro(meth)acrylate interpolymer having two different segments, one of which is fluorinated and oleophobic and the other of which is hydratable.

14 Claims, No Drawings

STAIN RESISTANT PROTECTIVE OVERCOAT FOR IMAGING ELEMENTS

CROSS REFERENCE TO RELATED APPLICATIONS

This application relates to commonly assigned copending application Ser. No. 09/018,867, filed simultaneously herewith and hereby incorporated by reference for all that it discloses. This application relates to commonly assigned copending application Ser. No. 09/019,092, filed simultaneously herewith and hereby incorporated by reference for all that it discloses.

FIELD OF THE INVENTION

This invention relates to an imaging element comprising a support material, and having thereon, at least one image forming layer and at least one outermost stain resistant layer containing a fluoropolymer.

BACKGROUND OF THE INVENTION

In the photographic industry the need to protect an imaging element from dirt and dust, scratches and abrasion, and deposition of stains has long been recognized. Significant progress has been made in the prevention of dirt and dust attraction through the use of antistatic layers in imaging elements. Improved protective overcoats have reduced the propensity for imaging elements to be scratched or abraded during manufacture and use. However, there is still a need to improve the stain resistance of imaging elements.

A wide variety of substances may adsorb onto or absorb into either the front or back surface of imaging elements and cause a permanent stain that degrades image quality. The deposition of these stain causing substances onto an imaging element may occur in many different ways. For example, dirt, fingerprints, and grease may be deposited onto the imaging element during handling. An imaging element may be stained when it comes in contact with a dirty surface or as a result of an accidental spill from, for example, a liquid drink such as coffee or soda. Other stains may be deposited onto a wet photographic element during film processing. For example, a tar-like material which is derived mostly from polymeric oxidized developer and which may be present at the surface of or on the walls of film processing solution tanks may be deposited during film processing. This tar may adhere to or diffuse into the surface layer of the imaging element and cause an extremely difficult to remove, brown-colored stain.

The treatment of articles such as textiles and food containers with soil and stain resistant compositions is well known. For example, U.S. Pat. Nos. 3,574,791 and 3,728,151 disclose block or graft copolymers which have two different segments, one of which is highly fluorinated and oleophobic and the other of which is hydrophilic. U.S. Pat. No. 4,579,924 describes fluorochemical copolymers useful as paper making additives which impart oil and water repellancy and food stain resistance to ovenable paperboard food containers. U.S. Pat. No. 5,350,795 describes aqueous and oil repellent compositions which cure at ambient temperature. The compositions comprise an aqueous solution or dispersion of a fluorochemical acrylate copolymer and a polyalkoxylated polyurethane having pendant perfluoroalkyl groups. U.S. Pat. No. Re. 34,348 discloses stain resistant compositions containing fluorinated polymers derived from acrylamide-functional monomers. Fluorocarbon containing coatings for hard tissue and surfaces of the oral environment that reduce staining and adhesion of bacteria and proteinaceous substances are described in U.S. Pat. Nos. 5,662,887 and 5,607,663.

For an imaging element the requirements for a stain resistant overcoat are rather unique. The stain resistant layer must not effect the transparency, color, or other imaging properties of the film. The application and curing of the stain resistant coating must be compatible with the imaging element manufacturing process. The overcoat layer must provide stain resistance when applied as a submicron-thick layer and protect against common stains such as grease and food and drink products, as well as stains specific to the imaging industry such as from the deposition of tar present in film processing tanks.

The present invention relates to improving the stain resistance of imaging elements by providing a thin, outermost layer that prevents tar pickup during film processing and resists permanent staining by dirt, grease, food and drink products, etc.

Further, the stain resistant outermost layer of the invention does not degrade the transparency, frictional characteristics, or other physical properties of the imaging element, and may be applied from solvent or aqueous media at low cost.

SUMMARY OF THE INVENTION

The present invention is an imaging element including a support, having thereon, at least one image forming layer and at least one outermost stain resistant layer containing a fluoropolymer. The fluoropolymer is a fluoro(meth)acrylate interpolymer with at least two different segments, one of which is fluorinated and oleophobic and the other of which is hydratable.

DETAILED DESCRIPTION OF THE INVENTION

The imaging elements of this invention can be of many different types depending on the particular use for which they are intended. Such elements include, for example, photographic, electrostatographic, photothermographic, migration, electrothermographic, dielectric recording and thermal-dye-transfer imaging elements. Imaging elements can comprise any of a wide variety of supports. Typical supports include cellulose nitrate film, cellulose acetate film, poly(vinyl acetal) film, polystyrene film, poly(ethylene terephthalate) film, poly(ethylene naphthalate) film, polycarbonate film, glass, metal, paper, polymer-coated paper, and the like.

Details with respect to the composition and function of a wide variety of different imaging elements are provided in U.S. Pat. No. 5,340,676 and references described therein. The present invention can be effectively employed in conjunction with any of the imaging elements described in the '676 patent.

The stain resistant coatings of the invention comprise a vinylic interpolymer having repeat units of A and B where A is derived from fluorine-containing acrylate or methacrylate monomers and B is derived from ethylenically unsaturated monomers containing hydratable groups.

More specifically, the unit A is derived from a fluoro (meth)acrylate or mixture of fluoro(meth)acrylates represented by the following formula:

$$(R_f)_p\text{LOCOCR}{=}\text{CH}_2$$

where the $R_f$ substituent is a monovalent, fluorinated, aliphatic organic radical having at least one carbon atom and as many as 20 carbon atoms, preferably, 2 to 10 carbon atoms. The skeletal chain of $R_f$ can be straight, branched, or cyclic, and can include catenary divalent oxygen atoms or trivalent nitrogen atoms bonded only to carbon atoms. Preferably, $R_f$ is fully fluorinated, but carbon-bonded hydrogen or chlorine atoms can be present as substituents on the skeletal chain of $R_f$. Preferably, $R_f$ contains at least a terminal perfluoromethyl group. Preferably, p is 1 or2.

The linking group L is a bond or hydrocarbyl radical linkage group containing from 1 to 12 carbon atoms and optionally substituted with and/or interrupted with a substituted or unsubstituted heteroatom such as O, P, S, N, R is either H or methyl. Preferably, the fluoro(meth)acrylate monomer contains at least 30 weight percent fluorine.

Non-limiting examples of fluoro(meth)acrylates useful in the present invention include:

$$CF_3(CF_2)_x(CH_2)_yOCOCR{=}CH_2$$

where x is 0to 20,preferably 2to 10, y is 1 to 10, and R is H or methyl $$HCF_2(CF_2)_x(CH_2)_yOCOCR{=}CH_2$$

where x is 0to 20, preferably 2 to 10, y is 1 to 10, and R is H or methyl

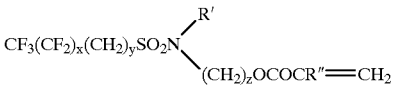

where x is 0 to 20, preferably 2 to 10, y is 1 to 10, z is 1 to 4, R' is alkyl or arylalkyl, and R" is H or methyl

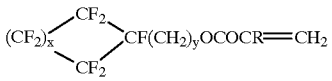

where x is 1 to 7, y is 1 to 10, and R is H or methyl $$CF_3(CF_2CF_2O)_x(CF_2O\ )_y(CH_2)_zOCOCR{=}CH_2$$

where x+y is at least 1 up to 20, z is 1 to 10, and R is H or methyl.

The B unit is derived from ethylenically unsaturated monomers containing hydratable, ionic or hydratable, nonionic groups or combinations of hydratable ionic and hydratable, nonionic groups. Monomers containing hydratable, ionic groups include mono- or multifunctional carboxyl containing monomers represented by the following formula:

$$CH_2{=}CRL(COOH)_x$$

where R is H, methyl, ethyl, carboxy, carboxymethyl, or cyano, L is a bond or hydrocarbyl radical linkage group containing from 1 to 12 carbon atoms and optionally substituted with and/or interrupted with a substituted or unsubstituted heteroatom such as O, P, S, N, x is equal to 1 or 2. This unit may be present in its protonated acid form or salt form after neutralization with an organic or inorganic base.

The B unit may also be derived from ethylenically unsaturated monomers containing sulfonic acid groups, such as vinyl sulfonic acid, styrene sulfonic acid, 2-acrylamido-2-methyl propane sulfonic acid, and the like. Alternatively, the B unit may be derived from ethylenically unsaturated monomers containing phosphorous acid or boron acid groups. These units may be present in their protonated acid form or salt form.

The B unit may be derived from substituted or unsubstituted ammonium monomers such as N,N,N-trialkylammonium methyl styrene, N,N,N-trialkylammonium alkyl (meth)acrylate, N,N,N-trialkylammonium (meth)acrylamide, etc., where the counterion may be fluoride, chloride, bromide, acetate, propionate, laurate, palmitate, stearate, etc.

The B unit may further be derived from ethylenically unsaturated monomers containing nonionic, hydrophilic groups. Suitable monomers include: mono- or multifunctional hydroxyl containing monomers such as hydroxyalkyl (meth)acrylates and N-hydroxyalkyl (meth)acrylamides; poly(oxyalkylene)-containing (meth)acrylates and poly (oxyalkylene)-containing itaconates, (meth)acrylamide, and vinyl pyrrolidone.

Preferably, the monomer containing nonionic, hydrophilic groups is a (meth)acrylate containing a poly(oxyalkylene) group in which the oxyalkylene unit has 2 to 4 carbon atoms, such as —$OCH_2CH_2$—, —$OCH_2CH_2CH_2$—, —$OCH(CH_3)CH_2$—, or —$OCH(CH_3)CH(CH_3)$—. The oxyalkylene units in said poly(oxyalkylene) being the same, as in poly (oxypropylene), or present as a mixture, as in a heteric straight or branched chain of blocks of oxyethylene units and blocks of oxypropylene units. The poly(oxyalkylene) group contains 4 to about 200, preferably, 5 to about 150 oxyalkylene units. A representative example of a poly (oxyalkylene)-containing meth(acrylate) suitable for the purpose of the present invention is represented by the following formula:

$$CH_2{=}CR'COO(CH_2CH_2O)_xR''$$

where R' and R" are independently H or methyl, x is 4 to 200.

The fluoro(meth)acrylate interpolymers of the invention comprise 10 to 90 weight % of units A and 10 to 90 weight % of units B. Non-interfering amounts of monomers other than those described above can also be incorporated into the fluoro(meth)acrylate interpolymers of this invention. For example, the interpolymers of this invention can contain up to about 50 weight percent of polymer units derived from ethylene, vinyl acetate, vinyl halide, vinylidene halide, acrylonitrile, methacrylonitrile, alkyl acrylates and metacrylates, glycidyl acrylate, glycidyl methacrylate, styrene, alkyl styrenes, vinylpyridine, vinyl alkyl ethers, vinyl alkyl ketones, butadiene, vinyl silanes, and mixtures thereof.

The fluoro(meth)acrylate interpolymers of the invention may be random, graft, or block copolymers. The molecular weight of the interpolymers may be from about 5000 to about 10,000,000.

The stain resistant overcoat layers of the present invention may comprise the fluoro(meth)acrylate interpolymer in combination with another polymer. In a preferred embodiment, the other polymer is a water soluble or water dispersible polymer. Water soluble polymers include, for example, gelatin, polyvinyl alcohol, polyvinyl pyrrolidone, cellulosics, poly styrene sulfonic acid and its alkali metal salts or ammonium salts, water soluble (meth)acrylic interpolymers, and the like. Water dispersible polymers that may be used in conjunction with the fluoro(meth)acrylate interpolymer include latex interpolymers containing ethylenically unsaturated monomers such as acrylic and methacrylic acid and their esters, styrene and its derivatives, vinyl chloride, vinylidene chloride, butadiene, acrylamides and methacrylamides, and the like. Other water dispersible polymers that may be used include polyurethane and polyester dispersions. Preferably, the stain resistant overcoat layer contains at least 70 weight % of the fluoro(meth)acrylate interpolymer.

The stain resistant overcoat layer compositions in accordance with the invention may also contain suitable crosslinking agents including aldehydes, epoxy compounds, polyfunctional aziridines, vinyl sulfones, methoxyalkyl melamines, triazines, polyisocyanates, dioxane derivatives such as dihydroxydioxane, carbodiimides, and the like. The crosslinking agents may react with the functional groups present on the fluoro(meth)acrylate interpolymer, and/or the other water soluble or water dispersible polymer present in the coating composition.

Matte particles well known in the art may also be used in the stain resistant overcoat layer compositions of the invention, such matting agents have been described in Research Disclosure No. 308119, published Dec 1989, pages 1008 to 1009. When polymer matte particles are employed, the polymer may contain reactive functional groups capable of forming covalent bonds with the fluoro (meth)acrylate interpolymer by intermolecular crosslinking or by reaction with a crosslinking agent in order to promote improved adhesion of the matte particles to the coated layers. Suitable reactive functional groups include: hydroxyl, carboxyl, carbodiimides, epoxide, aziridine, vinyl sulfone, sulfinic acid, active methylene, amino, amide, allyl, and the like.

The stain resistant overcoat layer can contain other additives such as magnetic recording particles, abrasive particles, conductive polymers, conductive metal oxide particles, coating aids, charge control surfactants, and lubricants. Useful lubricants include, for example, perfluorinated olefinic polymers, natural and synthetic waxes, silicone fluids, stearamides, oleamides, stearic acid, lauric acid, ethylene glycol distearate, ethylene glycol monostearate, and the like.

The stain resistant overcoat layers of the present invention may be applied from coating formulations containing up to 20% total solids by coating methods well known in the art. For example, hopper coating, gravure coating, skim pan/air knife coating, spray coating, and other methods may be used with very satisfactory results. The coatings are applied as part of the imaging element manufacturing process and are dried at temperatures up to 150 ° C. to give dry a coating weight of about 1 $mg/m^2$ to about 5000 $mg/m^2$, preferably, the dry coating weight is about 2 $mg/m^2$ to about 500 $mg/m^2$. The interpolymers may be applied from solvent or water-based coating formulations. Preferably, the fluoro(meth) acrylate interpolymers of the invention are water soluble or water dispersible and are applied from a water-based formulation.

The stain resistant overcoat layer of the invention is typically present on the side of the support opposite to the imaging layer and serves as an outermost backing layer, or an outermost layer coated on the top of an abrasion resistant backing layer, or an outermost layer coated on the top of an antistatic layer, or an outermost layer coated on a magnetic recording layer. For dry processed imaging products, for example, thermographic or photothermographic imaging elements, the stain resistant overcoat layer may also be present on top of the imaging layer. For wet processed imaging elements, for example, for imaging elements containing conventional black-and-white or color silver halide photographic emulsions, it is not desirable to have the stain resistant overcoat layer on top of the imaging layer since it may impede diffusion of film processing solutions into the photographic emulsion.

In a particularly preferred embodiment, the imaging elements of this invention are photographic elements, such as photographic films, photographic papers or photographic glass plates, in which the image-forming layer is a radiation-sensitive silver halide emulsion layer. Such emulsion layers typically comprise a film-forming hydrophilic colloid. The most commonly used of these is gelatin and gelatin is a particularly preferred material for use in this invention. Useful gelatins include alkali-treated gelatin (cattle bone or hide gelatin), acid-treated gelatin (pigskin gelatin) and gelatin derivatives such as acetylated gelatin, phthalated gelatin and the like. Other hydrophilic colloids that can be utilized alone or in combination with gelatin include dextran, gum arabic, zein, casein, pectin, collagen derivatives, collodion, agar-agar, arrowroot, albumin, and the like. Still other useful hydrophilic colloids are water-soluble polyvinyl compounds such as polyvinyl alcohol, polyacrylamide, poly (vinylpyrrolidone), and the like.

The photographic elements of the present invention can be simple black-and-white or monochrome elements comprising a support bearing a layer of light-sensitive silver halide emulsion or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic element according to this invention comprises a support bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material.

In addition to emulsion layers, the elements of the present invention can contain auxiliary layers conventional in photographic elements, such as overcoat layers, spacer layers, filter layers, interlayers, antihalation layers, pH lowering layers (sometimes referred to as acid layers and neutralizing layers), timing layers, opaque reflecting layers, opaque light-absorbing layers and the like. The support can be any suitable support used with photographic elements. Typical supports include polymeric films, paper (including polymer-coated paper), glass and the like. Details regarding supports and other layers of the photographic elements of this invention are contained in Research Disclosure, Item 36544, September, 1994.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in Research Disclosure, Item 36544, September, 1994, and the references listed therein.

The photographic silver halide emulsions utilized in this invention can contain other addenda conventional in the photographic art. Useful addenda are described, for example, in Research Disclosure, Item 36544, September, 1994. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

The photographic processing steps to which the raw film may be subject may include, but are not limited to the following:

1.) color developing→bleach-fixing→washing/stabilizing;
2.) color developing→bleaching→fixing→washing/stabilizing;
3.) color developing→bleaching→bleach-fixing→washing/stabilizing;
4.) color developing→stopping→washing→bleaching→washing→fixing→washing/stabilizing;
5.) color developing→bleach-fixing→fixing→washing/stabilizing;
6.) color developing→bleaching→bleach-fixing→fixing→washing/stabilizing;

Among the processing steps indicated above, the steps 1), 2), 3), and 4) are preferably applied. Additionally, each of the steps indicated can be used with multistage applications as described in Hahm, U.S. Pat. No. 4,719,173, with co-current, counter-current, and contraco arrangements for replenishment and operation of the multistage processor.

Any photographic processor known to the art can be used to process the photosensitive materials described herein. For instance, large volume processors, and so-called minilab and microlab processors may be used. Particularly advantageous would be the use of Low Volume Thin Tank processors as described in the following references: WO 92/10790; WO 92/17819; WO 93/04404; WO 92/17370; WO 91/19226; WO 91/12567; WO 92/07302; WO 93/00612; WO 92/07301; WO 02/09932; U.S. Pat. No. 5,294,956; EP 559,027; U.S. Pat. No. 5,179,404; EP 559,025; U.S. Pat. No. 5,270,762; EP 559,026; U.S. Pat. No. 5,313,243; U.S. Pat. No. 5,339,131.

The present invention is also directed to photographic systems where the processed element may be re-introduced into the cassette. These system allows for compact and clean storage of the processed element until such time when it may be removed for additional prints or to interface with display equipment. Storage in the roll is preferred to facilitate location of the desired exposed frame and to minimize contact with the negative. U.S. Pat. No. 5,173,739 discloses a cassette designed to thrust the photographic element from the cassette, eliminating the need to contact the film with mechanical or manual means. Published European Patent Application 0 476 535 A1 describes how the developed film may be stored in such a cassette.

The following examples are used to illustrate the present invention. However, it should be understood that the invention is not limited to these illustrative examples.

EXAMPLES

A subbed polyester support was prepared by first applying a subbing terpolymer of acrylonitrile, vinylidene chloride and acrylic acid to both sides of the support before drafting and tentering so that the final coating weight was about 90 mg/m$^2$. Aqueous formulations to be evaluated as stain resistant overcoats were coated on the subbed polyethylene terephthalate and dried at 120 ° C. Stain resistant overcoats were also applied over a crosslinked, gelatin layer which is typically used as a curl control backing layer for imaging elements. The stain resistant overcoats were also applied on a polyurethane layer as described in U.S. Pat. No. 5,679,505. This polyurethane layer had the following composition:

| Component | Dry Coverage mg/m$^2$ |
|---|---|
| Polyurethane (Witco Bond W232, Witco Corp.) | 1215 |
| Matte, polymethyl methacrylate beads, 1.47$\mu$m | 34.4 |
| Polyfunctional aziridine crosslinking agent, CX100 (Zeneca Resins) | 74.3 |
| Rohm & Haas surfactant, Triton X-100 | 9.7 |

The overcoats prepared were tested for film processor tar stain, common food and drink stains, adhesion, and friction coefficient.

Tar Stain Test: A simulated developer tar test was performed on the samples to determine their propensity for tar/stain build-up. The test was done at 42 ° C. and involved smearing tar harvested from a developer tank onto the coating in a developer bath followed by removal of the tar using dilute sulfuric acid. The resultant stain is indicative of the propensity of the coating for tar pickup. The resistance to tar stain was visually rated on a scale of 1 to 5, with 1 being the best performance, (i.e., no tar stain) and 5 being the worst performance (i.e., severe tar stain).

Common Stains Test: The test involved depositing food and drink products (ketchup and black coffee) onto the overcoat layer using a cotton swab. These products were left on the sample for 5 minutes and then the sample was rinsed with distilled water and wiped gently several times with a soft tissue that had been moistened in distilled water. The resistance to stains was visually rated on a scale of 1 to 5, with 1 being the best resistance and 5 being the worst resistance to permanent staining.

Adhesion Test: The wet adhesion was measured by scribbling a one millimeter wide line in the coating, placing the test sample in developing solution at 37.5 ° C. and rubbing across the scribe line in circular motions with a roughened rubber pad. The integrity of the area after rubbing is compared to that before rubbing to give a measure of wet adhesion.

Friction Test: Friction coefficient was measured according to the procedures set forth in ANSI IT 9.4-1992.

Examples 1 to 3 and Comparative Sample A to F

The following coatings were applied onto subbed polyethylene terephthalate support and tested for processor tar stain. Comparative Sample A comprises the uncoated, subbed polyethylene terephthalate support. Comparative Sample B comprises the polyurethane coating described above. Comparative Sample C comprises an acrylic latex designed to formulate chemical and water resistant coatings. Comparative Sample D comprises the fluoroolefin-vinyl ether copolymer described in commonly assigned copending application Ser. Nos. 08/873,607 and 08/879,648. Comparative Sample E comprises a fluorosurfactant having the formula $CF_3(CF_2)_7SO_2N(CH_2CH_3)CH_2COO(CH_2CH_2O)_{40}H$ and a hexamethoxymethyl melamine crosslinking agent (Cymel 303 Resin, Cytec Industries Inc.). Comparative Sample F comprises the carboxylic acid-functional fluoropolyether described in commonly assigned copending application Ser. No. Nos. 08/932,014 and 08/932,597. Example 1 comprises a fluoro(meth)acrylate containing anionic groups, nonionic, hydrophilic groups, and silanol groups available under the Tradename Fluorad FC-759 from 3M Company. Examples 2 and 3 comprise copolymers of a perfluoroalkyl (meth)acrylate and a polyoxyalkylene acrylate available under the tradenames Scotchban FC-829A and FC-808, respectively, both from 3M Company. The results shown in Table 1 clearly demonstrate that the coatings of the invention provide superior resistance to processor tar stain compared with subbed support, polyurethane and acrylic coatings, and various fluoropolymers described in the prior art. In addition, the coatings of the invention were very transparent and had excellent adhesion to the subbed support.

TABLE 1

| Coating | Composition | Dry Coverage mg/m$^2$ | Tar Stain Rating |
|---|---|---|---|
| Comparative Sample A | no coating | — | 3 |
| Comparative Sample B | Polyurethane | 1000 | 5 |
| Comparative Sample C | Neocryl A-645FS (Zeneca Resins Inc.) | 1000 | 4 |
| Comparative Sample D | Lumiflon FE-3000 (Asahi Glass Co. Ltd.) | 1000 | 4 |
| Comparative Sample E | Fluorad FC-431 (3M Company) | 50 | 5 |
| Comparative Sample F | Fomblin Fluorolink"C" (Ausimont USA, Inc.) | 10 | 4 |
| Example 1 | Fluorad FC-759 (3M Company) | 100 | 1 |
| Example 2 | Scotchban FC-829A (3M Company) | 150 | 1 |
| Example 3 | Scotchhban FC-808 (3M Company) | 150 | 2 |

Examples 4 to 15

Stain resistant overcoats of the invention were applied onto the polyurethane coating described earlier and the samples were tested for processor tar stain, the description of the coatings and the results obtained are given in Table 2. The results show that coatings of the invention provide excellent resistance to processor tar stain with and without crosslinking agent. The results also show that the friction coefficient may be easily modified with the addition of lubricant without affecting tar stain resistance.

TABLE 2

| Coating | Composition | Dry Coverage mg/m$^2$ | Tar Stain Rating | Frictio n Coeff. |
|---|---|---|---|---|
| Example 4 | Fluorad FC-759 | 5 | 1 | — |
| Example 5 | Fluorad FC-759 | 20 | 1 | 0.35 |
| Example 6 | Fluorad FC-759 | 50 | 1 | — |
| Example 7 | Fluorad FC-759 | 100 | 1 | — |
| Example 8 | Fluorad FC-759 w/10 wt % crosslinking agent* | 5 | 1 | — |
| Example 9 | Fluorad FC-759 w/10 wt % crosslinking agent* | 20 | 1 | 0.35 |
| Example 10 | Fluorad FC-759 w/10 wt % | 50 | 1 | — |

TABLE 2-continued

| Coating | Composition | Dry Coverage mg/m$^2$ | Tar Stain Rating | Friction Coeff. |
|---|---|---|---|---|
| | crosslinking agent* | | | |
| Example 11 | Fluorad FC-759 w/10 wt % crosslinking agent* | 100 | 1 | — |
| Example 12 | Fluorad FC-759 w/0.25 mg/m$^2$ carnauba wax† | 20 | 1 | 0.15 |
| Example 13 | Fluorad FC-759 w/1.0 mg/m$^2$ carnauba wax† | 20 | 1 | 0.11 |
| Example 14 | Scotchban FC-829A w/1.0 mg/m$^2$ carnauba wax† | 100 | 2 | 0.12 |
| Example 15 | Scotchban FC-829A w/1.0 mg/m$^2$ carnauba wax† | 200 | 1 | 0.10 |

*crosslinking agent is CX100 polyfunctional aziridine (Zeneca Resins)
†carnauba wax is Michemlube 160 (Michelman, Inc.)

Examples 16 to 18 and Comparative Sample G

Stain resistant overcoats of the invention were applied over a crosslinked gelatin layer and these samples were tested for resistance to common stains. Comparative Sample G comprises the non-overcoated crosslinked gelatin layer. The description of the coatings and the results obtained are given in Table 3. The results clearly show that coatings of the invention provide superior resistance to common stains compared with the crosslinked gelatin layer.

TABLE 3

| Coating | Composition | Dry Coverage mg/m$^2$ | Coffee Stain Rating | Ketchup Stain Rating |
|---|---|---|---|---|
| Comparative Sample G | Crosslinked gelatin | — | 4 | 4 |
| Example 16 | Fluorad FC-759 | 150 | 1 | 1 |
| Example 17 | Scotchban FC-829A | 150 | 1 | 2 |
| Example 18 | Scotchhban FC-808 | 150 | 1 | 2 |

Examples 19–24

Additional stain resistant copolymers were prepared and evaluated in the following examples.

Preparation of stain resistant copolymers: 2.8 g FLUORAD fluorochemical acrylate FX-13 (3M Company), 1.6 g acrylic acid, 2.4 g poly(ethylene glycol) methacrylate, molecular weight equal to 360 (Aldrich), 1.2 g isobutyl methacrylate, 0.05 g azobisisobutyronitrile, and 32 g tetrahydrofuran were weighed into a 50 ml one-necked round-bottom flask. The contents were sparged with nitrogen for 10 minutes, after which the flask was sealed with a rubber septum and placed in a constant temperature bath at 65° C. After 24 hours, the solution was cooled to room temperature, neutralized with triethylamine, then diluted with 100 g distilled water. Tetrahydrofuran was removed via rotary evaporator to yield an 8% solution containing a polymer comprising 35 weight % FX-13, 20 weight % acrylic acid, 30 weight % poly(ethylene glycol) methacrylate, and 15 weight % isobutyl methacrylate. Additional copolymer compositions were prepared in an analogous manner and these polymers were used in the following examples.

Stain resistant topcoats were applied over the polyurethane protective overcoat that had been previously applied over the antistat layer as described earlier. The stain resistant topcoats were then evaluated for tar stain resistance. The description of the copolymer compositions, coating compositions, and results obtained are given in Table 4.

TABLE 4

| | Copolymer Composition, weight % | | | | Dry | Tar |
|---|---|---|---|---|---|---|
| Coating | FX-13 | Acrylic acid | Poly(ethylene glycol) methacrylate | Isobutyl Methacrylate | Coverage, mg/m2 | Stain Rating |
| Example 19 | 35 | 20 | 30 | 15 | 500 | 1 |
| Example 20 | 60 | 10 | 30 | 0 | 500 | 1 |
| Example 21 | 15 | 10 | 30 | 45 | 1000 | 3 |
| Example 22 | 45 | 10 | 30 | 15 | 1000 | 1 |
| Example 23 | 35 | 20 | 30 | 15 | 170 | 1 |
| Example 24 | 60 | 10 | 30 | 0 | 100 | 1 |

* - all coatings contain 10 weight % CX100 aziridine crosslinking agent

The invention has been described in detail with particular reference to certain preferred embodiments thereof, but it will be understood that variations and modifications can be effected within the spirit and scope of the invention.

What is claimed is:

1. An imaging element comprising a support, at least one imaging layer superposed on a side of said support, and an outermost stain resistant overcoat superposed on said support comprising a fluoro(meth)acrylate interpolymer having repeating units of A and B wherein A comprises a fluorine containing acrylate or methacrylate monomer and B comprises an ethylenically unsaturated monomer containing hydratable groups.

2. The imaging element of claim 1, wherein A is represented by the following formula:

$$(R_f)_pLOCOCR{=}CH_2$$

wherein $R_f$ is a monovalent, fluorinated, aliphatic organic radical having from one 20 carbon atoms, p is 1 or 2, L is a bond or hydrocarbyl radical linkage group containing from 1 to 12 carbon atoms and R is either H or methyl.

3. The imaging element of claim 1, wherein B is represented by the following formula:

$$CH_2{=}CRL(COOH)_x$$

wherein R is hydrogen, methyl, ethyl, carboxy, carboxymethyl, or cyano, L is a bond or hydrocarbyl radical linkage group containing from 1 to 12 carbon atoms where x is 1 or 2.

4. The imaging element of claim 1, wherein B is an ethylenically unsaturated monomer containing sulfonic acid groups, phosphorous acid groups, boron acid groups, nonionic hydrophilic groups.

5. The imaging element of claim l, wherein said interpolymer comprises from 10 to 90 wt % of units A and from 10 to 90 weight % of units B.

6. The imaging element of claim 1, wherein said interpolymer further comprises ethylene, vinyl acetate, vinyl halide, vinylidene halide, acrylonitrile, methacrylonitrile, glycidyl acrylate, alkyl acrylates, alkyl methacrylates, glycidyl methacrylate, styrene, alkyl styrene, vinylpyridine groups, vinyl alkyl ether, vinyl alkyl ketone, butadiene and vinyl silane.

7. The imaging element of claim 1, wherein said interpolymers have a molecular weight of from about 5000 to about 10,000,000.

8. The imaging element of claim 1, wherein said overcoat further comprises crosslinking agents, magnetic recording particles, abrasive particles, conductive polymers, conductive metal oxide particles, coating aids, charge control surfactants, fillers, lubricants, or matte beads.

9. The imaging element of claim 1, wherein said overcoat is superposed on the side of the support opposite to the imaging layer.

10. The imaging element of claim 1, further comprising an abrasion resistant backing layer interposed between said support and said overcoat.

11. The imaging element of claim 1, further comprising an antistatic layer interposed between said support and said overcoat.

12. The imaging element of claim 1, further comprising a magnetic recording layer interposed between said support and said overcoat.

13. The imaging element of claim 1, wherein said overcoat is superposed on said imaging layer.

14. The imaging element of claim 1, wherein said imaging layer comprises a silver halide emulsion layer.

* * * * *